United States Patent [19]

Carella

[11] 4,328,625

[45] May 11, 1982

[54] ARCHERY BOWSIGHT (BETWEEN RANGE)

[76] Inventor: Richard F. Carella, 35572 Strathcona, Mt. Clemens, Mich. 48043

[21] Appl. No.: 132,367

[22] Filed: Mar. 21, 1980

[51] Int. Cl.[3] ..... F41G 1/46

[52] U.S. Cl. ..... 33/265

[58] Field of Search ..... 33/265, 276, 277; 124/87

[56] References Cited

U.S. PATENT DOCUMENTS

| | | | |
|---|---|---|---|
| 2,941,296 | 6/1960 | Grandt | 33/265 |
| 3,365,800 | 1/1968 | Carella | 33/265 |
| 3,455,027 | 7/1969 | Perkins | 33/265 |
| 3,798,783 | 3/1974 | Carella | 33/265 |

*Primary Examiner*—Harry N. Haroian

*Attorney, Agent, or Firm*—McGlynn and Milton

[57] ABSTRACT

A bowsight is provided for an archery bow including a support bracket for attachment generally parallel to the length of the archery bow. A plurality of sights are connected to and are longitudinally spaced along the support bracket. Each of the sights defines an outer longitudinal height and a smaller inner longitudinal height. The outer heights are successively smaller from sight to sight. Each of the outer longitudinal heights are positioned so that the bow will be properly aimed at a target when the outer longitudinal height of any one of the sights equals the apparent vertical height of the target. The inner longitudinal heights are successively smaller from sight to sight in the same direction as the outer heights become smaller. Each of the inner longitudinal heights are of a dimension so that the bow will be properly aimed when the inner longitudinal height of any one of the sights is equal to the apparent vertical height of the target. The bow is moved to place the target between that sight having the equal inner longitudinal height and the next smaller sight for proper aiming; thereby reducing the number of sights for a given number of target distances.

9 Claims, 1 Drawing Figure

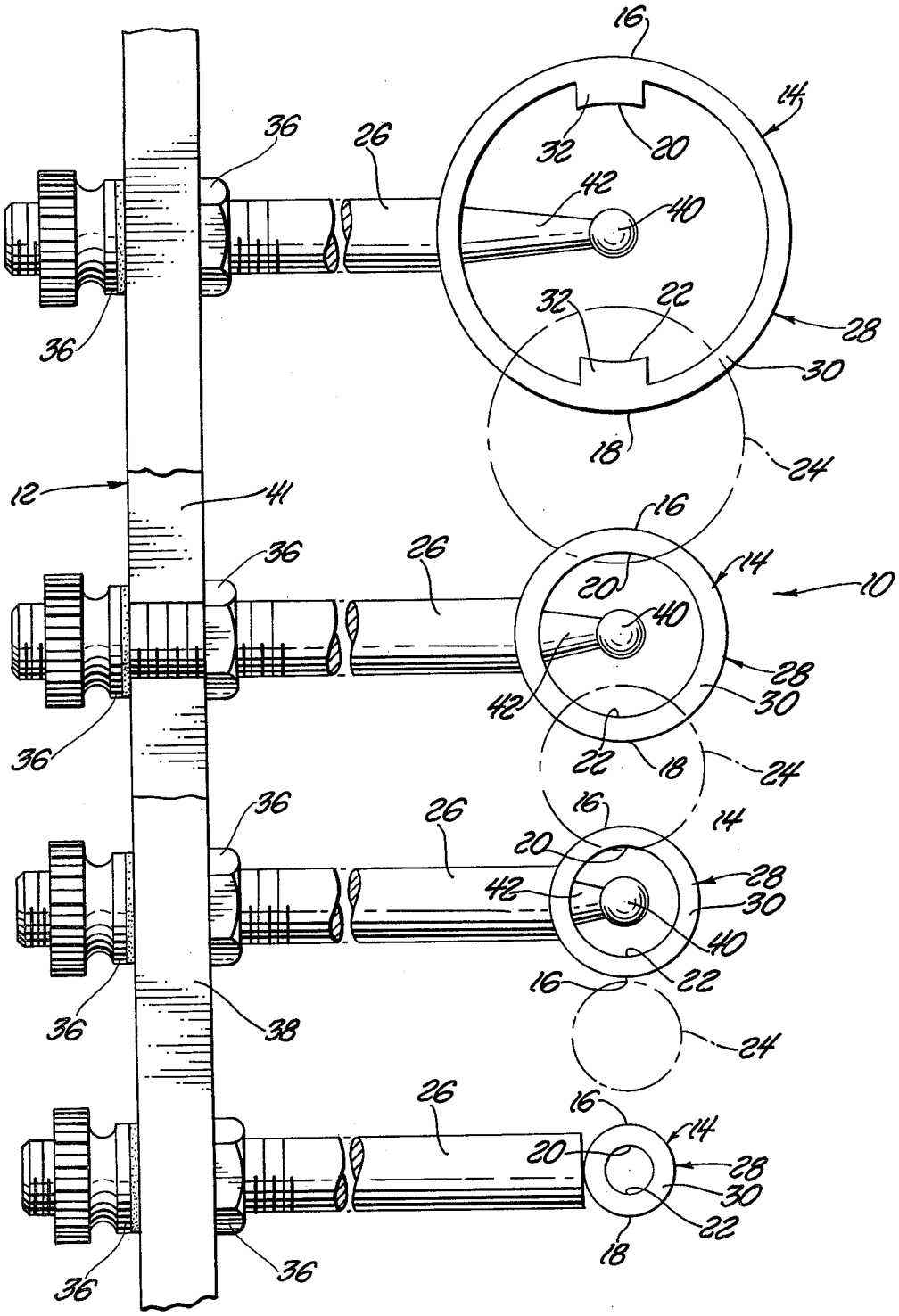
16
14
36
26
32
20
42
40
32
22
28
36
30
18
24
12
41
16
36
26
14
10
20
40
28
42
30
36
22
18
24
36
26
16
14
20
28
42
30
40
36
38
16
22
24
26
16
14
20
28
30
22
36
36
18

ARCHERY BOWSIGHT (BETWEEN RANGE)

BACKGROUND OF THE INVENTION (1) Field of the Invention

This invention relates to an archery bowsight.

(2) Description of the Prior Art

Presently, it is quite common for archers to use bowsights which are connected to their bow for sighting a target. Commonly, bowsights include a plurality of sighting elements of different vertical heights. Sighting is made possible by comparing the apparent vertical height of the target with the vertical heights of the several sights. However, problems arise when the target is at a distance which falls between two sights. In this case, the archer must estimate the tilt of the bow, a process which is time-consuming and often inaccurate.

Several prior art bowsights have been constructed so as to alleviate this problem. However, these bowsights have often been quite complex, requiring many parts which results in a more expensive bowsight. The present invention provides a bowsight having a simple construction with few parts and solves the problem of sighting targets which fall between the range of several bowsights.

SUMMARY OF THE INVENTION

The instant invention provides an archery bowsight comprising a support bracket for attachment generally parallel to the length of an archery bow and a plurality of sights connected to and longitudinally spaced along the support bracket. Each of the sights defines an outer longitudinal height and a smaller inner longitudinal height. The outer heights are successively smaller from sight to sight, each of the outer longitudinal heights being positioned so that the bow be properly aimed at a target when the outer longitudinal height of any one of the sights equals the apparent vertical height of the target. The inner longitudinal heights are successively smaller from sight to sight in the same direction as the outer heights become smaller. Each of the inner longitudinal heights are of a dimension so that the bow will be properly aimed when the inner longitudinal height of any one of the sights is equal to the apparent vertical height of the target. The bow is moved to place the target between that sight having the equal inner longitudinal height and the next smaller sight.

PRIOR ART STATEMENT

Examples of the prior art bowsights are the U.S. Pat. Nos. 3,365,800 to Carella, issued Jan. 30, 1968 and 3,798,783 to Carella, issued Mar. 26, 1974. Both patents teach the use of rings as sights for determining the tilt of a bow to shoot an arrow in the proper trajectory. However, the Carella '800 patent teaches a multiplicity of sights which require adjustments. Also, it is expensive due to the amount of parts which are required. The Carella '783 patent teaches the use of fewer rings, however, a problem arises in sighting an animal which is at a distance from the archer which falls between the range of any two rings. The archer must then estimate the tilt of the bow. This is inaccurate and time-consuming. Therefore, although the prior art patents are an attempt to solve the above problems, a problem still exists where either the tilt of the bow must be estimated when the target is between sights or a more expensive and more complex sight must be used.

BRIEF DESCRIPTION OF THE DRAWING

Other advantages of the present invention will be readily appreciated as the same becomes better understood by reference to the following detailed description when considered in connection with the accompanying drawings wherein there is shown a fragmentary elevational view of the invention.

DESCRIPTION OF PREFERRED EMBODIMENT

An archery bowsight constructed in accordance with the instant invention is generally shown at 10.

The bowsight 10 includes support means generally indicated at 12 for attachment generally parallel to the length of an archery bow. Such support means 12 have been previously described in the U.S. Pat. No. 3,365,800 to Carella. Generally, the support means 12 comprises a bracket 38 having at least one longitudinal slot 40 therein.

A plurality of sights generally indicated at 14 are connected to and longitudinally spaced along the support means 12. Each of the sights 14 defines an outer longitudinal height (the distance between point 16 and point 18) and a smaller inner longitudinal height (the distance between points 20 and point 22). The outer heights 16–18 are successively smaller from sight to sight. Each of the outer longitudinal heights 16–18 are positioned so that the bow will be properly aimed at a target when the outer longitudinal height 16–18 of any one of the sights 14 equals the apparent vertical height of the target. For example, if the archer is hunting a four-legged animal, the archer will frame the chest of the animal between the outer longitudinal heights 16–18 of the appropriate sight 14. The appropriate sight will be such that the archer will have set the range of the bow for the target (i.e., the proper trajectory of the arrow for the distance from the target) if the target is bracketed by any one of the outer longitudinal heights 16–18. The inner longitudinal heights 20–22 are successively smaller from sight to sight in the same direction as the outer heights 16–28 becomes smaller. Each of the inner longitudinal heights 20–22 are of a dimension so that the bow will be properly aimed when the inner longitudinal height 20–22 of any one of the sights 14 is equal to the apparent vertical height of the target and the bow is moved to place the target between that sight having the equal inner longitudinal height and the next smaller sight. In other words, if the target is not bracketed by any of the outer longitudinal heights but is bracketed by an inner longitudinal height defined by points 20 to 22 in any one of the sights, the archer having sighted the target, tilts the bow to a point 24 in between the sight having the inner longitudinal height sighting the target and the next lower sight, thereby properly aiming the bow in the proper trajectory. Therefore, the four sights 14 of the preferred embodiment of the instant invention includes three intermediary positions 24 whereby a target can be sighted. With prior art sights it would fall between the range of two sights. Furthermore, the intermediate sights 24 are calibrated to be quite accurate, therefore, a bowsight having four sights acts as a bowsight having seven sights without the complexity and extra cost of requiring seven sights.

The inner longitudinal height 20–22 of each sight 14 is greater than the outer longitudinal height 16–18 of the next adjacent smaller sight. In other words, the inner longitudinal height of the largest sight is greater than the outer longitudinal height of the next lower and smaller sight.

Each of the sights 14 includes a support shaft 26 extending from the support means 12 and a viewing means 28 connected to each of the shafts 26. Each of the viewing means 28 defines the inner and outer longitudinal heights for each sight 14. In the preferred embodiment of the instant invention, the viewing means 28 for each sight 14 blocks the view in the dimensions between the inner and outer longitudinal heights for that sight. In other words, the viewing means 28 is an opaque, solid structure defining the inner and outer longitudinal heights of each sight. An alternative construction could include four separate members wherein two inner members define the inner longitudinal height and two outer members define the outer longitudinal height. Therefore, this alternative type of construction would not block the view in the dimensions between the inner and outer longitudinal heights and yet still function in accordance with the instant invention.

In the preferred embodiment of the instant invention, the viewing means 28 comprises a circular ring 30. As previously stated, the viewing means can be constructed in alternative forms such as a square mounted on the end of a shaft and still function in accordance with the instant invention.

The preferred embodiment of the instant invention includes at least one ring 30 having an outer diameter defining the outer longitudinal height thereof and an inner diameter with a pair of longitudinally opposed projections 32 extending radially inward from the inner diameter of the ring 30 for defining the inner longitudinal height thereof. In other words, the projections 32 are an alternative method of defining the inner longitudinal height. Alternatively, the instant invention can be constructed with rings not including projections 32 and still function in accordance with the instant invention.

The assembly 10 includes attachment means for attaching the support shafts of any of the various longitudinal positions along the support means 12. As previously stated, an example of this type of construction is shown in the U.S. Pat. No. 3,365,800 to Carella. In the preferred embodiment of the instant invention the support means comprises a bracket 38 having at least one longitudinal slot 41 therein. The support shafts 26 extend through the slot 41. The attachment means maintains the support shafts 26 positioned in the slot 41. In the preferred embodiment of the instant invention the shafts 36 include threaded end portions. The attachment means includes nut 36 for adjustably securing the shaft 26 to the support means 12. A fine adjustment is accomplished by moving the shafts 26 along the slot 41. In other words, an archer may calibrate the bowsight at a target range by merely adjusting the positioning of the shaft 26 along the slot 41. Therefore, the sights can be finely calibrated so that the intermediate positions 24 are quite accurate.

In the preferred embodiment of the instant invention, the assembly 10 includes centering means for centering the target within at least one of the sights 14. The centering means comprises a small circular member 40 supported on the distal end of an arm at 42 extending radially inward from the associated ring 30. Other means for centering a target within a sight which are well known in the art can be adapted to be included with the instant invention without detracting from it.

The invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. An archery bowsight (10) comprising; support means (12) for attachment generally parallel to the length of an archery bow, a plurality of sights (14) connected to and longitudinally spaced along said support means (12), each of said sights (14) defining an outer longitudinal height (16–18) and a smaller inner longitudinal height (20–22), said outer heights (16–18) being successively smaller from sight to sight, each of said outer longitudinal heights (16–18) being positioned so that the bow will be properly aimed at a target when said outer longitudinal height (16–18) of any one of said sights equals the apparent vertical height of the target, said inner longitudinal heights (20–22) being successively smaller from sight to sight in the same direction as said outer heights (16–18) become smaller, each of said inner longitudinal heights (20–22) being of a dimension so that the bow will be properly aimed when said inner longitudinal height (20–22) of any one of said sights (14) is equal to the apparent vertical height of the target and the bow is moved to place the target between that sight having said equal inner longitudinal height and the next smaller sight, said inner longitudinal height of each sight being greater than the outer longitudinal height of the next adjacent smaller sight.

2. An assembly as set forth in claim 1 wherein each of said sights (14) includes a support shaft (26) extending from said support means (12) and viewing means (28) connected to each of said shafts (26), each of said viewing means (28) defining said inner and outer longitudinal heights for each sight (14).

3. An assembly as set forth in claim 2 wherein said viewing means (28) for each sight (14) blocks the view in the dimensions between said inner and outer longitudinal heights for that sight.

4. An assembly as set forth in claim 3 wherein each of said viewing means (28) comprises a circular ring (38).

5. An assembly as set forth in claim 4 wherein at least one of said rings (30) has an outer diameter defining said outer longitudinal height thereof and an inner diameter with a pair of longitudinally opposed projections extending radially inwardly from said inner diameter for defining said inner longitudinal height thereof.

6. An assembly as set forth in claim 4 including attachment means for attaching said support shafts (26) of any one of various longitudinal positions along said support means (12).

7. An assembly as set forth in claim 6 wherein said support means (12) comprises a bracket (38) having at least one longitudinal slot (41) therein, said support shafts (26) extending through said slot (41), said attachment means maintaining said support shafts (26) positioned in said slot (41).

8. An assembly as set forth in claim 7 including centering means (40) for centering the target within at least one of said sights (14).

9. An assembly as set forth in claim 8 wherein said centering means comprises a small circular member (40) supported on the distal end of an arm (42) extending radially inward from the associated ring (30).

* * * * *